US006704538B2

(12) United States Patent
Nakamura et al.

(10) Patent No.: US 6,704,538 B2
(45) Date of Patent: Mar. 9, 2004

(54) COLOR IMAGE FORMING APPARATUS AND COLOR TONER

(75) Inventors: Yasushige Nakamura, Kawasaki (JP); Shinichi Yaoi, Kawasaki (JP); Tomoaki Tanaka, Kawasaki (JP); Yoshimichi Katagiri, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/922,835

(22) Filed: Aug. 7, 2001

(65) Prior Publication Data

US 2002/0164182 A1 Nov. 7, 2002

(30) Foreign Application Priority Data

Mar. 30, 2001 (JP) ..... 2001-102442

(51) Int. Cl.[7] ..... G03G 9/09; G03G 15/20

(52) U.S. Cl. ..... 399/336; 219/216; 430/108.1; 430/124

(58) Field of Search ..... 399/335, 336; 430/108.1, 124, 105; 219/216

(56) References Cited

U.S. PATENT DOCUMENTS

| | | | | | |
|---|---|---|---|---|---|
| 4,260,237 | A | * | 4/1981 | Nishikawa | 399/336 |
| 4,699,863 | A | * | 10/1987 | Sawatari et al. | 430/124 X |
| 5,534,376 | A | * | 7/1996 | Mayo et al. | 430/58.8 |
| 5,572,311 | A | * | 11/1996 | Abe et al. | 399/127 |
| 6,136,488 | A | * | 10/2000 | Kushino et al. | 430/108.21 |
| 6,180,301 | B1 | * | 1/2001 | Mayo et al. | 430/124 X |
| 6,210,849 | B1 | * | 4/2001 | Fukuda et al. | 399/336 X |
| 2002/0106571 | A1 | * | 8/2002 | Katagiri et al. | 430/108.1 X |

FOREIGN PATENT DOCUMENTS

| | | | |
|---|---|---|---|
| JP | 58-102247 | | 6/1983 |
| JP | 58-102248 | | 6/1983 |
| JP | 60-57857 | | 4/1985 |
| JP | 60-57858 | | 4/1985 |
| JP | 60-63545 | | 4/1985 |
| JP | 60-63546 | | 4/1985 |
| JP | 60-131544 | | 7/1985 |
| JP | 60-131545 | | 7/1985 |
| JP | 60-133460 | | 7/1985 |
| JP | 61-132959 | | 6/1986 |
| JP | 63231361 | A | 9/1988 |
| JP | 6-348056 | | 12/1994 |
| JP | 7-191492 | | 7/1995 |
| JP | 08-320590 | * | 12/1996 |
| JP | 09-194445 | * | 7/1997 |
| JP | 09244439 | A | 9/1997 |
| JP | 10-39535 | | 2/1998 |
| JP | 11-38666 | | 2/1999 |
| JP | 11-65167 | | 3/1999 |
| JP | 11-125928 | | 5/1999 |
| JP | 11-125929 | | 5/1999 |
| JP | 11-125930 | | 5/1999 |
| JP | 2000-35689 | | 2/2000 |
| JP | 2000-147824 | | 5/2000 |
| JP | 2000-155439 | | 6/2000 |
| JP | 2000-214628 | * | 8/2000 |
| WO | WO99-13382 | | 3/1999 |

* cited by examiner

*Primary Examiner*—Sophia S. Chen
(74) *Attorney, Agent, or Firm*—Westerman, Hattori, Daniels & Adrian, LLP

(57) ABSTRACT

A color image forming apparatus forms a color image on a recording medium by using a toner including a binding resin, a coloring agent and infrared ray absorbent, and a light source for causing the toner to melt. The light source has a plurality of light emission peaks having wavelengths of $\lambda 1$, $\lambda 2$, $\lambda 3$, . . . , $\lambda n$ in a range of 500 nm through 3000 nm. Setting is made such that the following relationship is satisfied: $|\lambda 1-\Lambda 1|<100$ nm, and, also, $|\lambda 2-\Lambda 2|<100$ nm, where $\Lambda 1$ and $\Lambda 2$ denote absorption peak wavelengths of said infrared ray absorbent.

11 Claims, 5 Drawing Sheets

FIG.3

| MATERIAL | TYPE | MANUFACTURER | MAXIMUM ABSORPTION WAVELENGTH (nm) | MOLECULAR EXTINCTION COEFFICIENT (ε) | CORRESPONDING FLASH PERK |
|---|---|---|---|---|---|
| ANTHRAQUINONE | IR-750 | NIHON KAYAKU | 755 | 17500 | λ1 |
| POLYMETHINE | PS102 | NIHON KAYAKU | 820 | 167000 | |
| CYANINE | FT-10 | NIHON KAYAKU | 845 | 235000 | |
| PHTHALOCYANNINE | IR-3 | NIHON SHOKUBAI | 850 | 48000 | |
| NICKEL COMPLEX | SIR-128 | MITSUI CHEMISTRY | 855 | 60000 | |
| NAPHTHALOCYANINE | YKR-5010 | YAMAMOTO KASEI | 880 | 91200 | |
| NICKEL COMPLEX | SIR-130 | MITSUI CHEMISTRY | 930 | 55000 | λ2 |
| AMINIUM | IRG-005 | NIHON KAYAKU | 948 | 23900 | |
| YTTERBIUM OXIDE | UU-HP | SHIN-ETU CHEMISTRY | 980 | - | |
| DIIMONIUM | IRG-023 | NIHON KAYAKU | 1090 | 105000 | |
| STANNIC OXIDE | TL30S | SHOKUBAI KASEI | 1095 | - | |

FIG.4

| ITEM | | TONOR | EMBODIMENT 1 | EMBODIMENT 2 | EMBODIMENT 3 | EMBODIMENT 4 | EMBODIMENT 5 | EMBODIMENT 6 | EMBODIMENT 7 | EMBODIMENT 8 | EMBODIMENT 9 | EMBODIMENT 10 | COMPARISON EXAMPLE 1 | COMPARISON EXAMPLE 2 |
|---|---|---|---|---|---|---|---|---|---|---|---|---|---|---|
| | | | SCR-1 | SCR-2 | SCR-3 | SCR-4 | SCR-5 | SCR-6 | SCR-7 | SCR-8 | SCR-9 | SCR-10 | SCR-11 | SCR-12 |
| MATERIAL | PIGMENT | IRGALITE YELLOW WSR (CHIBA SPECIALITY) | 5.0 | 5.0 | 5.0 | 5.0 | 5.0 | 5.0 | 5.0 | 5.0 | 5.0 | 5.0 | 5.0 | 5.0 |
| | BINDER | POLYESTER (KAO) | 93.0 | 93.0 | 93.0 | 93.0 | 93.0 | 93.0 | 84.0 | 93.8 | 83.5 | 94.0 | 80.0 | 94.0 |
| | CCA | CCA-100 (CHUO GOSEI) | 1.0 | 1.0 | 1.0 | 1.0 | 1.0 | 1.0 | 1.0 | 1.0 | 1.0 | 1.0 | 1.0 | 1.0 |
| | INFRARED RAY ABSORBENT | IR-750 | 0.50 | | | | | | | | | | | |
| | | PS102 | | 0.50 | | | | | | | | | | |
| | | FT-10 | | | | | | | | | | | | |
| | | IR-3 | | | | 0.50 | | | | | | | | |
| | | SIR-128 | | | | | 0.50 | | | | | | | |
| | | YKR-5010 | | | 0.50 | | | 0.50 | 5.0 | 0.10 | 0.50 | 0.005 | 7.0 | 0.005 |
| | | SIR-130 | 0.50 | | | | | 0.50 | | | | | | |
| | | IRG-005 | | 0.50 | | | | | | | | | | |
| | | UU-HP | | | 0.50 | | | | 5.0 | | | | 7.0 | |
| | | IRG-023 | | | | 0.50 | | | | 0.10 | 10.0 | 0.005 | | 0.005 |
| | | TL30S | | | | | 0.50 | | | | | | | |
| | WAX | NP105 (MITSUI CHEMISTRY) | 0.5 | 0.5 | 0.5 | 0.5 | 0.5 | 0.5 | 0.5 | 0.5 | 0.5 | 0.5 | 0.5 | 0.5 |
| | EXTERNAL ADDING AGENT | H3004 (CLARIANT) | 0.5 | 0.5 | 0.5 | 0.5 | 0.5 | 0.5 | 0.5 | 0.5 | 0.5 | 0.5 | 0.5 | 0.5 |
| EVALUATION | | FIXING RATE (%) | 85.0 | 85.0 | 88.0 | 81.0 | 77.0 | 77.0 | 90.0 | 70.0 | 73.0 | 71.0 | 91.0 | 35.0 |
| | | JUDGEMENT FOR FIXING QUALITY | ○ | ○ | ○ | ○ | △ | △ | ◎ | △ | △ | △ | ◎ | × |
| | | TONOR HUE | ○ | ○ | ○ | ○ | ○ | ○ | ○ | ○ | ○ | ○ | × | ○ |
| | | | | | | | | | | | | | | |
| | | OPTICAL FIXING ENERGY (J/cm³) | 2.0 | 2.0 | 2.0 | 2.0 | 2.0 | 2.0 | 2.0 | 2.0 | 1.0 | 6.0 | 2.0 | 2.0 |
| | | | | | | | | | | | | | | |
| | | | | | | | | | | | | | | |

FIG.5

| ITEM | | TONOR | COMPARISON EXAMPLE 3 | COMPARISON EXAMPLE 4 | COMPARISON EXAMPLE 5 | COMPARISON EXAMPLE 6 | COMPARISON EXAMPLE 7 | COMPARISON EXAMPLE 8 | COMPARISON EXAMPLE 9 | COMPARISON EXAMPLE 10 | COMPARISON EXAMPLE 11 | COMPARISON EXAMPLE 12 | COMPARISON EXAMPLE 13 |
|---|---|---|---|---|---|---|---|---|---|---|---|---|---|
| | | | SCR-13 | SCR-14 | SCR-15 | SCR-16 | SCR-17 | SCR-18 | SCR-19 | SCR-20 | SCR-21 | SCR-22 | SCR-23 |
| MATERIAL | PIGMENT | IRGALITE YELLOW WSR (CHIBA SPECIALITY) | 5.0 | 5.0 | 5.0 | 5.0 | 5.0 | 5.0 | 5.0 | 5.0 | 5.0 | 5.0 | 5.0 |
| | BINDER | POLYESTER (KAO) | 93.0 | 93.0 | 93.0 | 93.0 | 93.0 | 93.0 | 93.0 | 93.0 | 93.0 | 93.0 | 93.0 |
| | CCA | CCA-100 (CHUO GOSEI) | 1.0 | 1.0 | 1.0 | 1.0 | 1.0 | 1.0 | 1.0 | 1.0 | 1.0 | 1.0 | 1.0 |
| | INFRARED RAY ABSORBENT | IR-750 | 1.0 | | | | | | | | | | |
| | | PS102 | | 1.0 | | | | | | | | | |
| | | FT-10 | | | 1.0 | | | | | | | | |
| | | IR-3 | | | | 1.0 | | | | | | | |
| | | SIR-128 | | | | | 1.0 | | | | | | |
| | | YKR-5010 | | | | | | 1.0 | | | | | |
| | | SIR-130 | | | | | | | 1.0 | | | | |
| | | IRG-005 | | | | | | | | 1.0 | | | |
| | | UU-HP | | | | | | | | | 1.0 | | |
| | | IRG-023 | | | | | | | | | | 1.0 | |
| | | TL30S | | | | | | | | | | | 1.0 |
| | WAX | NP105 (MITSUI CHEMISTRY) | 0.5 | 0.5 | 0.5 | 0.5 | 0.5 | 0.5 | 0.5 | 0.5 | 0.5 | 0.5 | 0.5 |
| | EXTERNAL ADDING AGENT | H3004 (CLARIANT) | 0.5 | 0.5 | 0.5 | 0.5 | 0.5 | 0.5 | 0.5 | 0.5 | 0.5 | 0.5 | 0.5 |
| EVALUATION | | FIXING RATE (%) | 49.0 | 55.0 | 58.0 | 62.0 | 60.0 | 68.0 | 68.0 | 65.0 | 55.0 | 62.0 | 55.0 |
| | | JUDGEMENT FOR FIXING QUALITY | × | × | × | × | × | × | × | × | × | × | × |
| | | TONOR HUE | ○ | ○ | ○ | ○ | ○ | ○ | ○ | ○ | ○ | ○ | ○ |
| | | | | | | | | | | | | | |
| | | OPTICAL FIXING ENERGY ($J/cm^3$) | 2.0 | 2.0 | 2.0 | 2.0 | 2.0 | 2.0 | 2.0 | 2.0 | 2.0 | 2.0 | 2.0 |
| | | | | | | | | | | | | | |
| | | | | | | | | | | | | | |

COLOR IMAGE FORMING APPARATUS AND COLOR TONER

BACKGROUND OF THE INVENTION

1. Field of the Invention

The present invention relates to an image forming apparatus in which a desired image is formed onto a recording medium such as a recording paper by using a flash light, and a color toner used therein. In particular, the present invention relates to an image forming apparatus in which, by employing a toner having a predetermined relationship with the flash light, a clear color image which has a high fixing quality can be formed by effectively utilizing the optical energy, and the above-mentioned toner.

2. Description of the Related Art

In a generally used electrophotographic image forming apparatus, a desired printed image is obtained through the following processes: (1) charging of a photosensitive body; (2) exposure of the photosensitive body (forming a latent image thereon); (3) development of the latent image with a toner; (4) transfer of the toner image onto a medium; and (5) fixing the toner image onto the medium.

The above-mentioned fixing of the toner image onto the recording paper or the like is achieved by a method of performing one of or both pressurizing and heating so as to melt the toner and then solidify and fixing it; or a method of irradiating optical energy so as to melt the toner and then solidify and fixing it.

Recently, the method of using optical energy has attracted attention as this method eliminates any problem occurring due to pressurizing or heating. That is, as this optical fixing method does not need pressuring toner for fixing it, it is not necessity to cause the toner to come into contact with (be pressed onto) a fixing roller or the like. Accordingly, no problem in that image resolution (reproducibility) is degraded through fixing process occurs.

Further, in this method, there is no need of heating by using a heat source, no waiting time for performing an actual printing operation until the heat source (such as a fixing roller) reaches a predetermined temperature through preheating is needed. Thus, it is possible to perform printing immediately after power is turned on.

Furthermore, as no high temperature heat source is needed, it is possible to prevent the temperature within the apparatus from increasing much. Further, there is no problem such that recording paper ignites by heat of the heat source when recording paper jams in the fixing device due to systematic failure.

However, in the optical fixing method, a fixing quality of a color toner of blue or red having a low light absorption rate is low in comparison to a case of a black toner. In order to solve this problem, many proposals have been made for improving the fixing quality by adding infrared ray absorbent into the toner.

For example, Japanese Laid-Open Patent Applications Nos. 58-102247, 58-102248, 60-63545, 60-63546, 60-57858, 60-57857, 60-131545, 60-133460, 61-132959, 6-348056, 7-191492, 10-39535, 11-38666, 11-125930, 11-125928, 11-125929, 11-65167, and, further, International Patent Publication WO99-13382, Japanese Laid-Open Patent Applications Nos. 2000-35689, 2000-147824, 2000-155439 disclose adding a material which absorbs light in the infrared zone so as to attempt both clear color and satisfactory optical fixing quality. However, it has not been possible to achieve a satisfactory fixing quality.

With regard to fixing of toner, Japanese Laid-Open Patent Application No. 63-231361 discloses a technique of causing light of wavelength of 4000 through 6000 nm to be absorbed by a binder resin for toner. However, there is a limit for improving the fixing quality of a color image by increasing a light absorption rate through modification of a resin.

SUMMARY OF THE INVENTION

The present invention has been devised in order to solve the above-mentioned problems, and, to provide a color image forming apparatus in which fixing is performed by using a toner including an infrared ray absorbent having an effective absorption for a light emission peak of a fixing light source, and the toner. By configuring so, it is possible to perform fixing of the color toner in an improved level corresponding to that of a monochrome toner.

A color image forming apparatus according to the present invention forms a color image on a recording medium by using a toner at least comprising binding resin, coloring agent and infrared ray absorbent (which may comprise one or a plurality of types of infrared ray absorbents), and a light source for causing the toner to melt, wherein:

the light source has at least one light emission peak in a range of 500 nm through 3000 nm; and setting is made such that the following relationship is satisfied:

$$|\lambda-\Lambda|<100 \text{ nm}$$

where:

$\lambda$ denotes the wavelength of the light emission peak; and $\Lambda$ denotes the wavelength of an absorption peak wavelength of the infrared ray absorbent.

A color image forming apparatus according to another aspect of the present invention forms a color image on a recording medium by using a toner comprising at least binding resin, coloring agent and infrared ray absorbent (which may comprise one or a plurality of types of infrared ray absorbents), and a light source for causing the toner to melt, wherein:

the light source has a plurality of light emission peaks having wavelengths of $\lambda 1, \lambda 2, \lambda 3, \ldots, \lambda n$ in a range of 500 nm through 3000 nm; and setting is made such that the following relationship is satisfied:

$$|\lambda 1-\Lambda 1|<100 \text{ nm, and, also, } |\lambda 2-\Lambda 2|<100 \text{ nm}$$

where $\Lambda 1$ and $\Lambda 2$ denote the wavelengths of absorption peak wavelengths of the infrared ray absorbent.

In each of the above-mentioned configurations, by employing the toner which includes the infrared ray absorbent which efficiently absorbs the optical energy at the light emissions peaks of the light source, it is possible to form a color image having superior fixing quality and hue. Further, in comparison to the related art, it is possible to reduce the required amount of infrared ray absorbent to be used, and, thus, to reduce the cost.

Further, assuming that the above-mentioned light emission peaks $\lambda 1, \lambda 2, \lambda 3, \ldots, \lambda n$ have light emission intensities in the stated order from the highest one, the absorption peak wavelengths $\Lambda 1$ through $\Lambda n$ of the infrared ray absorbent may be set corresponding to the wavelengths $\lambda 1$ through $\lambda n$.

Thereby, as the toner includes the infrared ray absorbent which utilizes the energy at the light emission peaks having the high light emission intensities, it is possible to utilize the optical energy more efficiently in forming a color image.

The light source may comprise a flash lamp having the light emission peaks in a range of 800 through 850 nm and also in a range of 850 through 1000 nm; and the infrared ray absorbent may have the absorption peak in at least one of a range of 700 through 900 nm and a range of 900 through 1100 nm.

Further, the (first) infrared ray absorbent having the absorption peak in the range of 700 through 900 may comprise at least one of cyanine, anthraquinone, phthalocyanine, naphthalocyanine, polymethine, and nickel complex; and the (second) infrared ray absorbent having the absorption peak in the range of 900 through 1100 nm may comprise at least one of aminium, diimonium, stannic oxide, ytterbium oxide, ytterbium phosphate, and nickel complex.

Thereby, through the effective combination between the flash lamp and infrared ray absorbent, it is possible to perform effective color image formation.

An addition amount of the infrared ray absorbent to the toner may be 0.01 through 12 weight parts with respect to 100 weight parts of toner.

The energy of the light source may be 1.0 through 6.0 $J/cm^2$.

Further, a color toner according to the present invention is melted by optical energy from a light source having a plurality of light emission peaks having wavelengths of $\lambda 1$, $\lambda 2$, $\lambda 3$, . . . , $\lambda n$ in a range of 500 nm through 3000 nm, and comprises at least binding resin, coloring agent and infrared ray absorbent, wherein at least the following relationship is satisfied:

$$|\lambda 1-\Lambda 1|<100 \text{ nm, and, also, } |\lambda 2-\Lambda 2|<100 \text{ nm}$$

where $\Lambda 1$ and $\Lambda 2$ denote absorption peak wavelengths of the infrared ray absorbent.

Then, assuming that the above-mentioned light emission peaks $\lambda 1$, $\lambda 2$, $\lambda 3$, . . . , $\lambda n$ have light emission intensities in the stated order from the highest one, the absorption peak wavelengths $\Lambda 1$ through $\Lambda n$ of the infrared ray absorbent may correspond to the wavelengths $\lambda 1$ through $\lambda n$.

Other objects and further features of the present invention will become more apparent from the following detailed description when read in conjunction with the accompanying drawings.

BRIEF DESCRIPTION OF THE DRAWINGS

FIG. 3 shows a list of infrared ray absorbents added to color toners formed for the embodiments of the present invention; and FIGS. 4 and 5 show compositions and evaluations for the toners of the embodiments of the present invention and those of comparison examples.

DETAILED DESCRIPTION OF THE PREFERRED EMBODIMENTS

With reference to figures, a color image forming apparatus employing an optical fixing form in each embodiment of the present invention will now be described.

Figure 1:
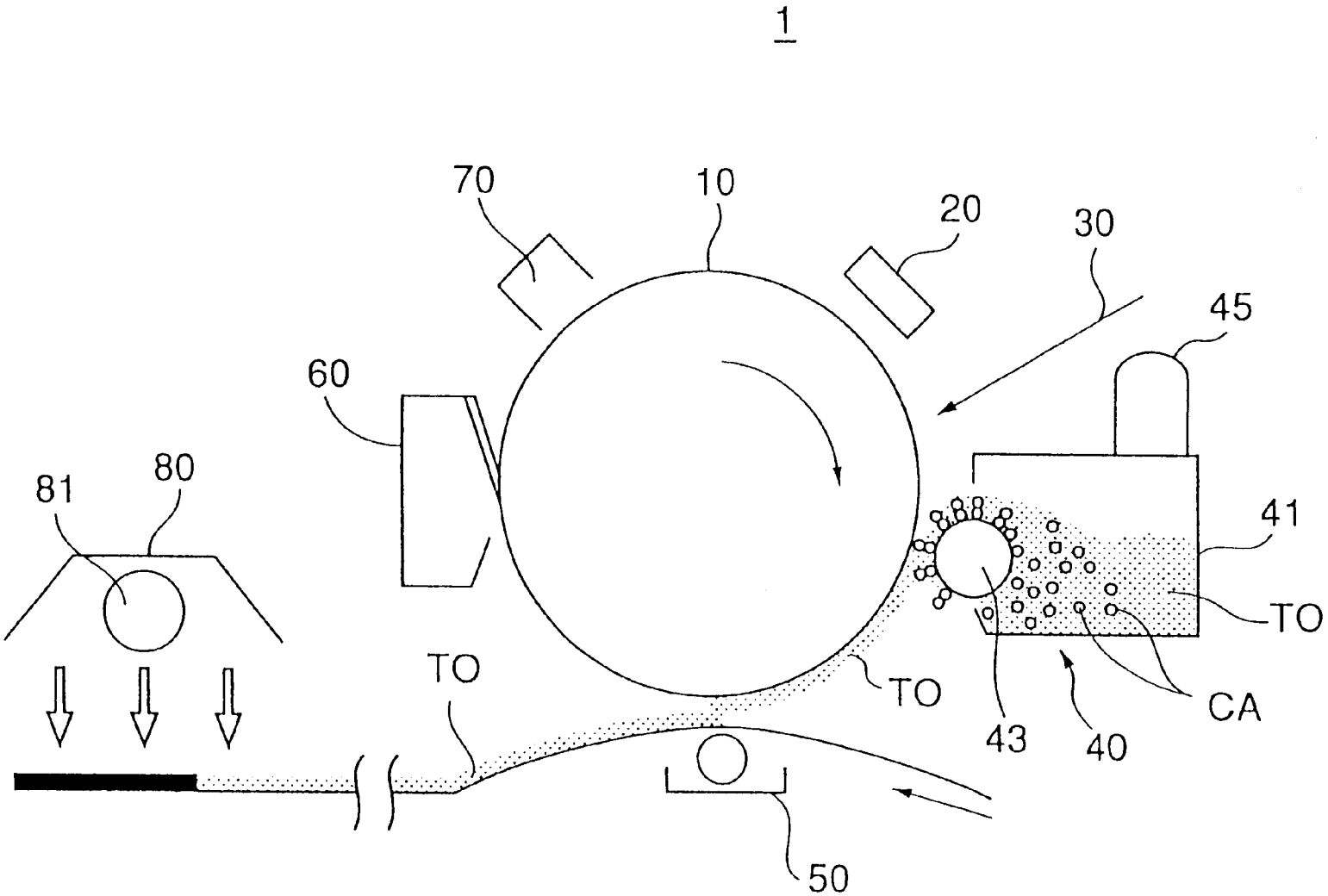
FIG. 1 typically shows a general configuration of an image forming apparatus employing a two-component development form in each embodiment of the present invention.

FIG. 1 typically shows a general configuration of an image forming apparatus 1 in a two-component development system. This apparatus 1 is of a high-speed development type of a process speed of 1152 mm/s, for example. Around a photosensitive body 10 made of amorphous silicon, a charger 20, an exposure unit 30, a development unit 40, a transfer unit 50, a cleaner 60, an electricity remover 70, a flash fixing unit 80 including a xenon flash lamp 81 acting as a light source (simply referred to as a lamp 81, hereinafter), and so forth.

The development unit 40 includes a development agent container 41, a development roller 43, stirring blades, not shown in the figure, and so forth. Toner particles TO and carrier particles CA in the development container 41 are made contact together so that a predetermined electrification charging amount is given to the toner. A toner cartridge 45 is installed on the development agent container 41.

In the image forming apparatus 1, the above-mentioned lamp 81 of the flash fixing unit 80 has a plurality of light emission peaks in a range of 500 through 3000 nm. Further, the above-mentioned lamp 81 has light emission energy of 1.0 through 6.0 $J/cm^2$, and, it is preferable to employ polyester as a binder resin which serves as a base of the toner.

In particular, in a case where mono-colors such as two colors are formed in the image forming apparatus 1, it is preferable that the energy of the xenon flash lamp 81 is made to be 1 through 3 $J/cm^2$. In a case where superimposing of full-color four colors is made, it is preferable that the energy of the xenon flash lamp 81 is made to be 2 through 6 $J/cm^2$.

As the above-mentioned photosensitive body 10, as well as amorphous silicon, an inorganic photosensitive body of selenium or the like, or an organic photosensitive body such as polysilane, phthalopolymethine or the like may be used. In particular, an amorphous silicon photosensitive body is preferable as it has a longer life.

Although the two-component development system is employed in the image forming apparatus 1, it is also possible to employ a magnetic or non-magnetic single-component development system instead, for example. The carrier used in the above-mentioned two-component development agent may be well-known magnetite, ferrite, iron powder or the like.

The toner used in the image forming apparatus 1 includes at least a binder resin (binding resin) serving as a base, a coloring agent, and an infrared ray absorbent which will be described later, and, as the necessity arises, a binding supplementary agent such as a wax, a charging control agent, an external adding agent and so forth are added. Thus, a final form of the toner is prepared. The above-mentioned infrared ray absorbent has an absorption peak wavelength corresponding to a light emission peak of the lamp 81 so that optical energy from the lamp 81 can be efficiently utilized thereby. The specific composition of this toner will be described later.

Description will now be made for a fact that the toner used in the image forming apparatus according to the present invention utilizes energy of light emission peak of the lamp 81 efficiently. The lamp 81 has a plurality of light emission peaks. By selectively using the infrared ray absorbent having an absorption for the light emission peak at which the optical energy becomes high, it is possible to perform the optical fixing efficiently, and also to effectively reduce the required amount of the toner.

Further, infrared ray absorbents are expensive, and are colored in many cases. If a large amount of a single type of infrared ray absorbent is used, degradation in hue of a fixed image and/or cost increase may result. Accordingly, it is advantageous to efficiently reduce the amount of the infrared ray absorbent to be used.

Therefore, the image forming apparatus according to the present invention utilizes the optical energy from the flash lamp efficiently by using one or a plurality of infrared ray absorbents having absorption peak wavelengths according to the state of the optical energy from the flash lamp. As a result, as it is possible to reduce the total required amount of infrared ray absorbent, it is possible to reduce the cost. Further, as the required amount of each infrared ray absorbent, and, thus, the total required amounts thereof is reduced, it is possible to prevent the infrared ray absorbent from adversely affecting the hue of the fixed image.

From the above-described point of view, it is preferable that the infrared ray absorbent to be contained in the toner exhibits absorption corresponding to a plurality of light emission peaks of the flash lamp by one type thereof. Even when a plurality of infrared ray absorbents are used, the number of types thereof is preferably up to the order of three.

Further, relationship between the peak wavelength $\lambda$ of the flash lamp and the absorption peak wavelength $\Lambda$ of the infrared ray absorbent used in the image forming apparatus according to the present invention will now be described.

In the image forming apparatus, the infrared ray absorbent having the absorption peak wavelength $\Lambda$ satisfying the following relationship (1) with respect to the peak wavelength $\lambda$ of the flash lamp is selected and is added to the toner:

$$|\lambda 1-\Lambda 1|<100 \text{ (nm)} \tag{1}$$

This infrared ray absorbent has the absorption peak wavelength $\Lambda$ including the peak wavelength $\lambda$ of the flash lamp. Accordingly, this absorbent efficiently utilizes high optical energy at the light emission peak of the flash lamp, and, as a result, it is possible to improve the fixing quality of the toner in comparison to the related art.

The reason why the difference between the peak wavelength $\lambda$ of the flash lamp and the absorption peak wavelength $\Lambda$ has been defined within 100 nm is that, if the difference is larger than 100 nm, the fixing quality becomes degraded sharply. In contrast thereto, as long as the difference in wavelength is within 100 nm, the infrared ray absorbent can efficiently utilize the peak energy of the lamp.

A case where two types of infrared ray absorbents are used will now be described.

Assuming that the lamp has peak wavelengths of $\lambda 1$, $\lambda 2$, $\lambda 3$, . . . , $\lambda n$, one type or a plurality of types of infrared ray absorbents having absorption peak wavelengths $\Lambda 1$ and $\Lambda 2$ which satisfy the following relationship (2) with respect to the above-mentioned two wavelengths $\lambda 1$ and $\lambda 2$, for example, are selected:

$$|\lambda 1-\Lambda 1|<100 \text{ (nm), and, also, } |\lambda 2-\Lambda 2|<100 \text{ (nm)} \tag{2}$$

The toner containing these infrared ray absorbents can remarkably improve the fixing quality in comparison to the related art.

Further, it is preferable to select the wavelengths having the strongest and second strongest light emission intensities as the above-mentioned wavelengths $\lambda 1$ and $\lambda 2$, as it is possible to utilize the energy of the flash lamp more efficiently.

Similarly, it is also possible to set requirement in a case where three types of infrared ray absorbents are used. That is, assuming that the lamp has peak wavelengths of $\lambda 1$, $\lambda 2$, $\lambda 3$, . . . $\lambda n$, one type or a plurality of types of infrared ray absorbents having absorption peak wavelengths $\Lambda 1$, $\Lambda 2$ and $\Lambda 3$ which satisfy the following relationship (3) with respect to the above-mentioned three wavelengths $\lambda 1$, $\lambda 2$ and $\lambda 3$, for example, are selected:

$$|\lambda 1-\Lambda 1|<100 \text{ (nm)}, \tag{3}$$

$$|\lambda 2-\Lambda 2|<100 \text{ (nm), and, also,}$$

$$|\lambda 3-\Lambda 3|<100 \text{ (nm)}$$

The toner containing these three types of infrared ray absorbents can further improve the fixing quality in comparison to the above-mentioned case where the two light emission peaks are utilized.

Further, also in this case, it is preferable to select the wavelengths having the strongest, second strongest and third strongest light emission intensities as the above-mentioned wavelengths $\lambda 1$, $\lambda 2$ and $\lambda 3$, as it is possible to utilize the energy of the flash lamp further efficiently.

Figure 2:
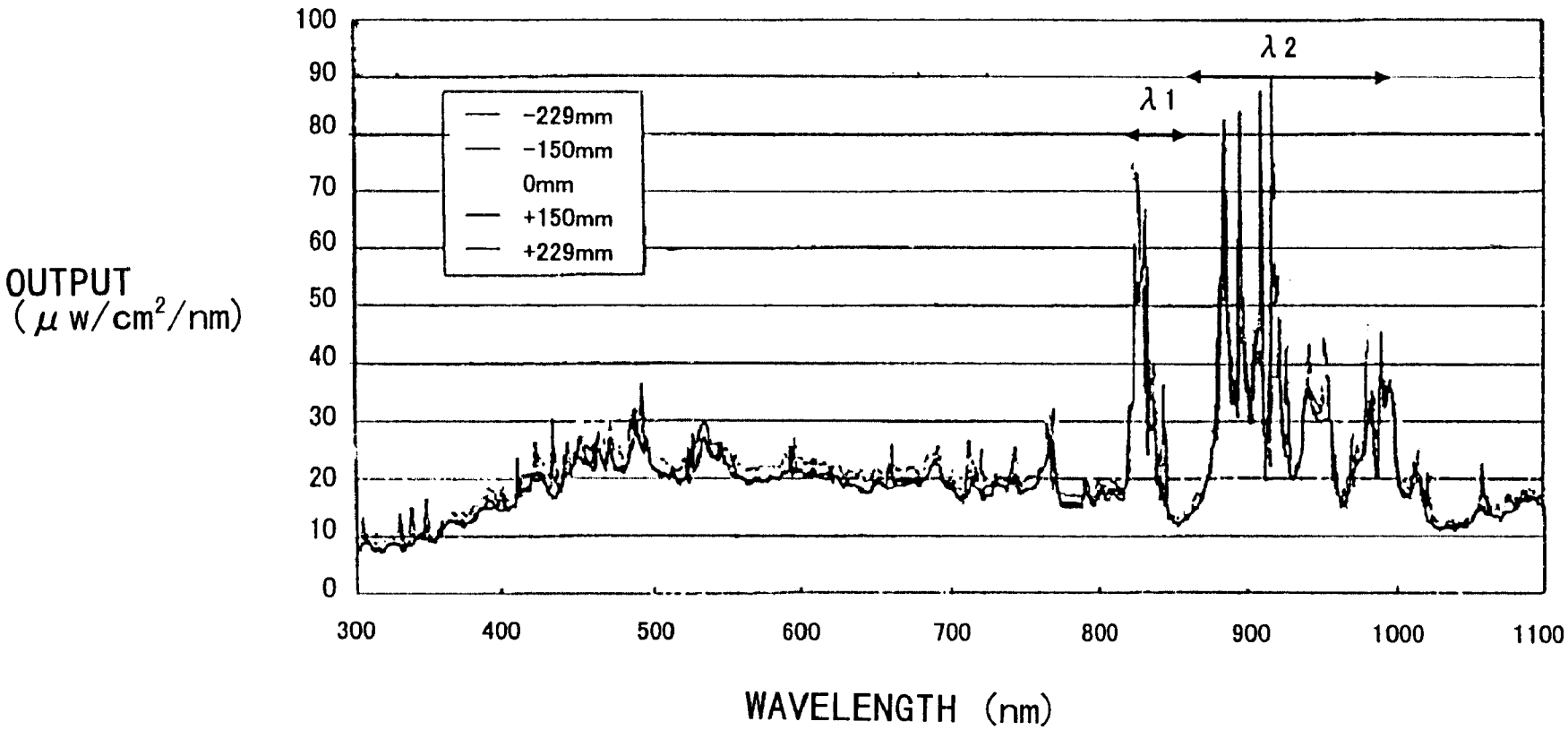
FIG. 2 shows an example of flash light emission peaks of a flash lamp shown in FIG. 1.

FIG. 2 illustrates an example of flash light emission peaks of the lamp 81. For this example, a spectradiometer (USR-40V) was used, and, measurement was performed in a range of 300 through 1100 nm at positions of the center, ±150 mm from the center, and ±229 mm from the center along the longitudinal direction of the flash tube. As shown in FIG. 2, the lamp 81 has a first peak group in a range of 800 through 850 nm, and a second peak group in a range of 850 through 1000 nm. For example, it is possible to adopt the wavelength of 800 through 850 in the first peak group as the above-mentioned $\lambda 1$, and adopt the wavelength of 850 through 1000 nm in the second peak group as the above-mentioned $\lambda 2$.

Accordingly, one type or a plurality of types of infrared ray absorbents having absorption including these wavelengths of light emission peaks are contained and, thus, the color toner is prepared. In each of the present embodiments, both a first infrared ray absorbent having an absorption peak in a range of 700 through 900 nm, and a second infrared ray absorbent having an absorption peak in a range of 900 through 1100 nm are used simultaneously. Thereby, it is possible to improve the fixing quality of the color toner to a level equivalent to the level in a case where a black (monochrome) toner is made fixed.

The wavelength of infrared ray absorbent can be measured by the following manner, for example:

A polyester resin solution is prepared by solving 2.5 g of polyester resin into a toluene/MEK (25 mL/25 mL) mixed solution. 50 mg of infrared ray absorbent is added to 1 mL of this polyester resin solution, and, then, this is shaken by a ultrasonic washer for five minutes, and, thus, a dispersed liquid is obtained. 2 cc of this dispersed liquid is dropped onto a glass substrate (1×5×5 mm) by using a pipette approximately ten drops. Then, a thin film is formed by a spincoater (rotation speed: 500 rpm, SPINNER IH-III-A, made by Kyoei Semiconductor Co., Ltd.) therefrom, and is dried. For a thus-obtained test sample, a transmission spectrum is measured by a spectrophotometer (UV-1600PC, made by Shimazu Seisakusho).

As the above-mentioned first infrared ray absorbent, cyanine, anthraquinone, phthalocyanine, naphthalocyanine, polymethine, or nickel complex may be used. As the above-mentioned second infrared ray absorbent, aminium, diimonium, stannic oxide, ytterbium oxide, ytterbium phosphate, or nickel complex may be used.

The amounts of the above-mentioned infrared ray absorbents to be added are preferably total 0.01 through 12 weight parts for the 100 weight parts of the toner, and, in particular, is more preferably 0.1 through 6 weight parts. When it is less than 0.01 weight parts, light absorption is not satisfactorily performed, and, thus, it is not possible to ensure positive fixing. When it is more than 12 weight parts, the color of the infrared ray absorbent may adversely affect a resulting fixed image, as mentioned above.

The other composition of the toner used in each of the present embodiments may be the same as a toner in the related art. As the binder resin used in the toner, there is no particular limitation, and, commonly used styrene-acrylic resin, epoxy resin, polyether polyol resin, urethane, urea, nylon or the like may be used. However, for the optical fixing, it is preferable to use polyester or polyether polyol resin as they have less odor. It is also possible to use both of them.

Further, it is possible to use, together therewith, well known as a binding supplementary agent, a sort of wax such as polyethylene, polypropylene, ester wax, carnauba, Fischer-Tropsch wax, paraffin wax, rise wax, or the like.

Further, the toner may have white inorganic fine particles mixed therein for the purpose of improving fluidity thereof. The rate at which it is mixed to the toner is 0.01 through 5 weight parts, and, preferably, is 0.01 through 2.0 weight parts. As the inorganic fine particles, silica fine particles, alumina, titanium oxide, barium titanate, magnesium titanate, calcium titanate, strontium titanate, zinc oxide, silica sand, clay, mica, wollastonite, diatomite, chromium oxide, cerium oxide, red ocher, antimony trioxide, magnesium oxide, zirconium oxide, barium sulfate, barium carbonate, calcium carbonate, silicon carbide, silicon nitride, or the like may be used, for example. However, in particular, silica fine particles are preferable. It is possible to use well-known material such as silica, titan, resin fine powder, alumina or the like, together therewith.

As the above-mentioned coloring agent, no particular limitation is made, and any conventional coloring agent may be used, for example, aniline blue (C. I. No. 50405), carco-oil blue (C. I. No. azoic Blue3), chrome yellow (C. I. No. 14090), ultramarine blue (C. I. No. 77103), dupon-oil red (C. I. No. 26105), quinoline yellow (C. I. No. 47005), methylene blue chloride (C. I. No. 52015), phthalocyanine blue (C. I. No. 74160), malachite green oxalate (C. I. No. 42000), lamp black (C. I. No. 77266), rose Bengal (C. I. No. 45435), ECR-181 (Pg. No. 122) or the like may be used. Further, it is also possible to mix them appropriately.

The amount of the above-mentioned coloring agent to be used is normally 0.1 through 20 weight parts for the toner 100 weight parts, and, in particular, is preferably 0.5 through 10 weight parts.

Embodiments

The above-mentioned embodiments of the present invention in cases where a plurality of color toners are used for image formation will now be described.

FIG. 3 lists the infrared ray absorbents added to the color toners used in the embodiments. The anthraquinone through naphthalocyanine of the upper half are examples of the first infrared ray absorbents having absorption peak wavelengths including the wavelengths λ1 of the first peak group shown in FIG. 2. The nickel complex through stannic oxide of the lower half thereof are examples of the second infrared ray absorbents having absorption peak wavelengths including the wavelengths λ2 of the second peak group shown in FIG. 2.

In each of the embodiments, both the above-mentioned first and second infrared ray absorbents are used for forming the toner, and a color image is formed thereby.

Further, for comparison to the color toners used in the above-described embodiments, comparison examples are also shown for color toners for which only one type of infrared ray absorbent is used, and color toners for which, although both the first and second infrared ray absorbents are used, amounts of addition are not appropriate.

Evaluations for the toners in the embodiments and toners in the comparison examples are collectively shown in FIGS. 4 and 5. Tests/inspections and evaluations made therefor will now be described.

Printer Initial Evaluation Test Example

In evaluation, the development agent in which 5 wt % of toner was mixed into 95 wt % of carrier was used. In flash fixing quality evaluation, a modified machine of a high-speed printer PS2160 (8000 lines/min, made by Fujitsu) having the same configuration as that of the image forming apparatus shown in FIG. 1 was used, and fixing quality was measured while the flash energy was changed.

Fixing Rate Testing Method (Tape Exfoliation)

First, an image status A density on an ordinary paper on which a toner image had been fixed was measured. Then, an exfoliation tape (trade name: 'Scotch Mending Tape' made by Sumitomo 3M Co., Ltd.) was caused to adhere to the toner image on the ordinary paper, then, the exfoliation tape was removed therefrom, and the status A density on the ordinary paper after the removal of the exfoliation tape was measured. The image printed density after the tape removal with respect to the same before the tape removal was expressed by percentage as FIXING RATE in the figures. In the measurement of the status A density, a 938 Spectrodentitometer (made by X-Rite Co., Ltd.) was used. The evaluation was made as follows:

Fixing rate of not more than 70%: X;

Fixing rate of 70 through 80%: Δ;

Fixing rate of 80 through 90%: ○; and

Fixing rate of not less than 90%: ◎.

It is noted that the practical level is not less than 80%.

Hue

A color when the toner of SCR-0 was fixed in toner adhesion amount of 0.5 mg/cm$^2$ was determined as a basic color, and a*, b* and L in toner adhesion amount of 0.5 mg/cm$^2$ for respective toners were measured, and, then, color differences ΔE were obtained. The measurement of a*, b* and L was performed through X-Rite. Evaluation was such that ○ was given for ΔE of not less than 5.

In FIGS. 4 and 5, the compositions of the color toners used in the embodiments are also shown. With reference to them, the toners prepared in the embodiments will now be described. Each toner is a color toner of two components.

Preparation of Carrier

Acrylic resin (trade name: BR-85 made by Mitsubishi Rayon Co., Ltd.) was coated 2 wt % onto carrier core of 60 μm of magnetite particle through a fluidized bed, was dried, and, thus, magnetite carrier coated by the above-mentioned resin was obtained.

Toner Production

1) Embodiment 1, production of toner (SCR-1)

According to the composition of embodiment 1 shown in FIG. 4, predetermined materials were put into a henshel mixer, and, then, pre-mixing thereof was performed. Then, they were mixed by a extruder, were broken into pieces roughly by a hammer mill, were broken into pieces finely by a jet mill, were classified by an air-flow classifier, and, thus, yellow coloring fine particles having a volume average particle diameter of 8.5 μm were obtained. Then, thereto, 0.5 weight parts of hydrophobic silica fine particles (H3004 Clariant Japan) was externally added.

2) Embodiments 2 through 10, and Comparison Examples 1 through 13, Production of Toner (SCR-2 through 10) and Toner (SCR-11 through 23)

Also, according to the compositions shown in FIGS. 4 and 5, by the same method as that for the toner SCR-1, coloring fine particles having a volume average diameter of 8.5 μm were obtained. Then, the external adding agent was added thereto externally, and, thus, the toners of SCR-2 through 23 were obtained.

Evaluation of Toner

As described above, the toner in each embodiment includes two types of infrared ray absorbents. For each of the embodiments 1 through 7 (SCR-1 through 7), 0.5 weight parts of one of the first group of infrared ray absorbents (having the peak λ1) and 0.5 weight parts of one of the second group of infrared ray absorbents (having the peak λ2) shown in FIG. 3 were selected, and total 1 weight part was added to the toner.

It can be seen from the figure that each of all the toners (SCR-1 through 7) of the embodiments 1 through 7 had a satisfactory fixing quality, and, the hue of the thus-formed image was satisfactory.

Further, in the embodiment 8 (SCR-8), naphthalocyanine (YKR-5010) and diimonium (IRG-023) were used. In comparison to the embodiments 1 through 7, it can be seen that, even though the addition amounts were remarkably reduced, the required fixing quality and hue were obtained. Accordingly, it can be said that use of naphthalocyanine and diimonium in combination is preferable.

Further, in the embodiments 9 and 10 (SCR-9, 10), also naphthalocyanine (YKR-5010) and diimonium (IRG-023) were used. From these embodiments, it can be seen that, as the addition amounts of the infrared ray absorbents are increased, the optical fixing energy of the lamp can be reduced, while, as the addition amounts of the infrared ray absorbents are decreased, the optical fixing energy of the lamp should be increased, so as to form an image having the required fixing quality. That is, by selecting the optical fixing energy from a range of 1.0 through 6.0 J/cm$^2$, and adjusting the addition amounts of the infrared ray absorbents appropriately, it is possible to form a clear color image having a superior fixing quality.

The comparison example 1 (SCR-11) is an example in which the addition amounts of the infrared ray absorbents were too much. In this case, it was seen that although the fixing quality was very satisfactory, the colors of infrared ray absorbents remained in the fixed image, and, thus, the hue was degraded. The comparison example 2 (SCR-12) is an example in which the addition amounts of the infrared ray absorbents were short. In this case, the hue was satisfactory while the fixing was poor.

As described above, the addition amounts of the infrared ray absorbents are preferably total 0.01 through 12 weight parts for the toner of 100 weight parts, and, in particular, are further preferably total 0.1 through 6 weight parts therefor.

With regard to the comparison example 2 and embodiment 10 together, the toner (SCR-12) and toner (SCR-10) have the same toner composition, and, have different optical fixing energies. From the comparison therebetween, it can be seen that the amounts of the infrared ray absorbents and the optical fixing energy are mutually complementary. That is, within some extent, it is possible to adjust the addition amounts of the infrared ray absorbents and the optical fixing energy so as to perform an appropriate image formation.

Further, in each of the comparison examples 13 through 23 shown in FIG. 5, the toner (SCR-13 through 23) has the total 1.0 weight part of the infrared ray absorbent corresponding to each of the embodiments 1 through 7. However, each of these comparison examples used only one type of infrared ray absorbent. As can be seen from FIG. 5, each of all of these comparison examples results in poor fixing.

Thus, in the image forming apparatus in each embodiment, the lamp 81 for the optical fixing of toner image has a plurality of light emission peaks, and a toner including infrared ray absorbents which efficiently absorb the energy of these light emission peaks. Thereby, it is possible to form a color image having superior fixing quality and hue. Further, in comparison to the related art, it is possible to reduce the amounts of infrared ray absorbents to be used. Accordingly, it is possible to reduce the cost.

In the above-mentioned embodiments, Irgalite Yellow WSR (Chiba Speciality) was used as the coloring agent. However, it is possible to obtain a similar result when another color such as blue, red or the like is used.

Further, in the above-mentioned embodiments, the infrared ray absorbents corresponding to the respective two light emission peak wavelengths λ1 and λ2 shown in FIG. 2 were used. However, it is not necessary to be limited thereto. Only an infrared ray absorbent but having two wavelengths λ1 and λ2, if any, may be used. Further, it is not necessary that one infrared ray absorbent having the wavelength λ1 is used, and, it is possible that a plurality of infrared ray absorbents corresponding to the wavelength λ1 may be used. It is preferable that, consequently, amount(s) of infrared ray absorbent(s) is (are) adjusted so as to effectively reduce the total amount.

Further, in each of the above-mentioned embodiments, the lamp has the two groups of light emission peaks. However, it is also possible to use a lamp having three or more groups of light emission peaks.

Further, the present invention is not limited to the above-described embodiments, and variations and modifications may be made without departing from the scope of the present invention.

The present application is based on Japanese priority application No. 2001-102442, filed on Mar. 30, 2001, the entire contents of which are hereby incorporated by reference.

What is claimed is:

1. A color image forming apparatus which forms a color image on a recording medium by using a toner comprising at least a binding resin, a coloring agent and an infrared ray absorbent, and a light source for causing the toner to melt, wherein:

said light source has a plurality of light emission peaks having wavelengths of λ, λ2, λ3, λn within a full range inclusively beginning from 300 nm and ending at 1100 nm; and setting is made such that at least the following relationship is satisfied:

$$|\lambda 1-\Lambda 1|<100 \text{ nm, and, also, } |\lambda 2-\Lambda 2|<100 \text{ nm}$$

where $\lambda 1$ and $\lambda 2$ denote the wavelengths of said light emission peaks; and where $\Lambda 1$ and $\Lambda 2$ denote wavelengths of absorption peak wavelengths of said infrared ray absorbent:

wherein the energy of said light source is within a full range inclusively beginning from 2.0 and ending at 6.0 $J/cm^2$ when superimposing of four colors.

2. The image forming apparatus as claimed in claim 1, wherein:

assuming that the above-mentioned light emission peaks $\lambda 1, \lambda 2, \lambda 3, \ldots, \lambda n$ have light emission intensities in the stated order from the highest one, the absorption peak wavelengths $\Lambda 1$ through $\Lambda n$ of said infrared ray absorbent are set corresponding to said wavelengths $\lambda 1$ through $\lambda n$.

3. The image forming apparatus as claimed in claim 1, wherein:

said light source comprises a flash lamp having the light emission peaks in a range from 800 nm through 850 nm and in a range from 850 nm through 1000 nm; and said infrared ray absorbent has an absorption peak in at least one of a range from 700 nm through 900 nm and a range from 900 nm through 1100 nm.

4. The image forming apparatus as claimed in claim 3, wherein:

the infrared ray absorbent having the absorption peak in the range of 700 through 900 nm comprises at least one of cyanine, anthraquinone, phthalocyanine, naphthalocyanine, polymethine, and nickel complex; and the infrared ray absorbent having the absorption peak in the range of 900 through 1100 nm comprises at least one of aminium, diimonium, stannic oxide, ytterbium oxide, ytterbium phosphate, and nickel complex.

5. The image forming apparatus as claimed in claim 1, wherein an addition amount of the infrared ray absorbent to the toner is 0.01 through 12 weight parts with respect to 100 weight parts of toner.

6. The image forming apparatus as claimed in claim 1, wherein the energy of said light source is 1.0 through 6.0 $J/cm^2$.

7. A color toner which is melted by optical energy from a light source having a plurality of light emission peaks having wavelengths of $\lambda 1, \lambda 2, \lambda 3, \ldots, \lambda n$ in a full range inclusively beginning from 300 nm and ending at 1100 nm, and comprises at least a binding resin, a coloring agent and an infrared ray absorbent, wherein the following relationship is satisfied:

$$|\lambda 1-\Lambda 1|<100 \text{ nm, and, also, } |\lambda 2-\Lambda 2|<100 \text{ nm}$$

where $\lambda 1$ and $\lambda 2$ denote the wavelengths of said light emission peaks; and where $\Lambda 1$ and $\Lambda 2$ denote absorption peak wavelengths of said infrared ray absorbent: wherein the energy of said light source is within a full range inclusively beginning from 2.0 and ending at 6.0 $J/cm^2$ when superimposing of four colors.

8. The color toner as claimed in claim 7, wherein:

assuming that the above-mentioned light emission peaks $\lambda 1, \lambda 2, \lambda 3, \ldots, \lambda n$ have light emission intensities in the stated order from the highest one, the absorption peak wavelengths $\Lambda 1$ through $\Lambda n$ of said infrared ray absorbent are set corresponding to said wavelengths $\lambda 1$ through $\lambda n$.

9. The color toner as claimed in claim 7, wherein said light source comprises a flash lamp having the light emission peaks in a range from 800 through 850 nm and in a range of 850 nm through 1000 nm; and said infrared ray absorbent has an absorption peak in at least one of a range from 700 nm through 900 nm and a range from 900 nm through 1100 nm.

10. The color toner as claimed in claim 9, wherein:

the infrared ray absorbent having the absorption peak in the range of 700 through 900 nm comprises at least one of cyanine, anthraquinone, phthalocyanine, naphthalocyanine, polymethine, and nickel complex; and the infrared ray absorbent having the absorption peak in the range of 900 through 1100 nm comprises at least one of aminium, diimonium, stannic oxide, ytterbium oxide, ytterbium phosphate, and nickel complex.

11. A color image forming apparatus which forms a color image on a recording medium by using a toner comprising at least a binding resin, a coloring agent and an infrared ray absorbent, and a light source for causing the toner to melt, wherein said light source has at least one light emission peak within an inclusive range from 300 nm to 1100 nm; and a setting is made such that the following relationship is satisfied:

$$|\lambda 1-\Lambda 1|<100 \text{ nm}$$

where:

$\lambda$ denotes the wavelength of said light emission peak; and $\Lambda$ denotes the wavelength of an absorption peak wavelength of said infrared ray absorbent;

wherein said light source comprises a flash lamp having light emission peaks in an inclusive range from 800 nm to 850 nm and an inclusive range from 850 nm to 1000 nm;

wherein said infrared ray absorbent has an absorption peak in at least one of an inclusive range from 700 nm to 900 nm and an inclusive range from 900 nm to 1100 nm;

wherein the infrared ray absorbent having an absorption peak in an inclusive range from 700 nm to 900 nm comprising at least one of cyanine, anthraquinone, phthalocyanine, naphthalocyanine, polymethine, and nickel complex; and wherein the infrared ray absorbent having an absorption peak in an inclusive range from 900 nm to 1100 nm comprising at least one of aminium, diimonium, stannic oxide, ytterbium oxide, ytterbium phosphate, and nickel complex:

wherein the energy of said light source is within a full range inclusively beginning from 2.0 and ending at 6.0 $J/cm^2$ when superimposing of four colors.

* * * * *